US008873788B1

(12) United States Patent
Coombs

(10) Patent No.: US 8,873,788 B1
(45) **Date of Patent: *Oct. 28, 2014**

(54) IN-GROUND AUDIO SUB WOOFER AND METHOD OF INSTALLATION

(76) Inventor: Jeffery James Coombs, Lake Havasu City, AZ (US)

( * ) Notice: Subject to any disclaimer, the term of this patent is extended or adjusted under 35 U.S.C. 154(b) by 561 days.

This patent is subject to a terminal disclaimer.

(21) Appl. No.: 13/220,581

(22) Filed: Aug. 29, 2011

Related U.S. Application Data

(60) Provisional application No. 61/402,563, filed on Aug. 30, 2010.

(51) Int. Cl.
*H04R 1/02* (2006.01)

(52) U.S. Cl.
USPC ..... 381/338; 381/334; 381/336; 381/189; 381/387; 181/150; 181/153; 181/199

(58) Field of Classification Search
CPC ..... H04R 1/44; H04R 1/02; H04R 1/2865; H04R 1/026; H04R 1/345; H04R 1/025; H04R 1/323; H04R 1/34; H04R 1/021; H04R 2201/021; G10K 11/18
USPC ..... 381/334, 338, 350, 337, 345, 386, 387, 381/189, 336; 181/149, 150, 175, 196, 197, 181/153, 199
See application file for complete search history.

(56) References Cited

U.S. PATENT DOCUMENTS

| | | | | |
|---|---|---|---|---|
| 1,905,544 | A | 7/1929 | Witisiein | |
| 2,210,477 | A * | 8/1940 | Bialk et al. | 181/150 |
| 3,642,091 | A * | 2/1972 | Nohara et al. | 181/150 |
| 3,679,845 | A | 7/1972 | Geloso | |
| 4,574,906 | A | 3/1986 | White et al. | |
| 5,535,284 | A * | 7/1996 | Thornhill et al. | 381/338 |
| 5,802,193 | A * | 9/1998 | Kieltyka | 381/386 |
| 6,021,208 | A * | 2/2000 | Kin-Lung | 381/338 |
| 6,345,685 | B1 | 2/2002 | Wells et al. | |
| 6,801,633 | B2 * | 10/2004 | Tracy | 381/389 |
| 7,066,613 | B2 | 6/2006 | Vishwamitra | |
| 2005/0123162 | A1 * | 6/2005 | Huffman | 381/337 |
| 2007/0223723 | A1 | 9/2007 | Haase | |
| 2012/0087529 | A1 * | 4/2012 | Coombs et al. | 381/334 |

OTHER PUBLICATIONS

James Loudspeaker, "Landscape Speakers", <http://web.archive.org/web/20090218014141/http://jamesloudspeaker.com/index.cfm?page=landscape>, retrieved by Internet Archive on Feb. 18, 2009.*

(Continued)

*Primary Examiner* — Curtis Kuntz
*Assistant Examiner* — Joshua A Kaufman
(74) *Attorney, Agent, or Firm* — Paul B. Heynssens Attorney at Law PLC

(57) ABSTRACT

A sub woofer for in-ground installation and a method of installation. The sub woofer has a cylindrical enclosure or housing having a driver, electronics and a band pass filter. The driver cone is coaxial with the axis of the cylindrical housing. A port tube assembly having a tuned port tube and a resilient elbow interface is attached to an end wall of the housing in an eccentric position with the port tube projecting vertically and terminating at a canopy. The installation requires placing the enclosure in an excavation and positioning the housing and port assembly so a predetermined above ground spacing exists between the upper end of the above ground port tube and grade.

9 Claims, 5 Drawing Sheets

(56) References Cited

OTHER PUBLICATIONS

James Loudspeaker, archived Web pages, Aug. 4, 2008 to May 29, 2010.

Mark Fleichman, CEDIA 2008, "James Loudspeaker Achieves the Impossible" Posted Sep. 4, 2008.

M. Park, James Loudspeaker "Subterranean Installation Guide", Dated Jul. 11, 2006.

* cited by examiner

IN-GROUND AUDIO SUB WOOFER AND METHOD OF INSTALLATION

CROSS-REFERENCE TO RELATED APPLICATION

This application claims the benefit of U.S. Provisional Patent Application No. 61/402,563 filed Aug. 30, 2010, the contents of which are hereby incorporated by reference.

TECHNICAL FIELD

This description relates generally to sub woofer speakers and more specifically to sub woofer speakers for in-ground installation in an outdoor audio system and also method of installing an in-ground sub woofer.

BACKGROUND

Loudspeakers typically refer to an audio reproduction component, or transducer, that converts an electrical signal to sound. The term loudspeaker can refer to an enclosure or cabinet that contains one or more individual speakers sometimes referred to as drivers or driver speakers (because they "drive" the surrounding air). A signal containing all audio frequencies may be applied to a single speaker to reproduce the entire audio signal. However, certain frequencies may not be reproduced faithfully due to the limitations of constructing a driver to reproduce all frequencies from low to high. For example high pitched sounds may roll of or be attenuated, and low frequency bas sounds may sound muddled.

Individual drivers may be constructed, or optimized to reproduce a range of audio frequencies better than other frequencies. And, often a plurality of drivers may be provided to reproduce an audio signal. The drivers may also be disposed in different enclosures or housings, or alternatively in a common housing. Electronics typically called a crossover network may be provided within an enclosure to split or route incoming audio signal frequencies into bands of signals most appropriately applied to a driver designed for that frequency range's optimal reproduction. In the past such networks have been passive circuits; such circuits were in effect a filter network.

Drivers suitable for low frequency reproduction often tend to be physically large to reproduce low frequency signals accurately. And also to reproduce the low frequency signals the driver components do not move fast, so heavier components may be used. High frequency drivers may be small in size, since their components must move faster in reproducing high pitched signals, thus light weight elements that move the air are desirable.

Inexpensive loudspeakers may just utilize a single driver. However in premium loudspeaker systems multiple drivers may be incorporated in the speaker system. Various driver may include tweeters (for reproduction of high frequencies), mid range drivers (for reproduction of midrange frequencies), woofers (for reproduction of low frequencies), and increasingly sub-woofers (for reproduction of very low frequencies). Sub woofers produce a sound that is often felt as much as heard. Sub woofers are typically responsible for the effect produced when a teenager in a car pulls up next to another car, and even though the adjacent car has its windows closed the low frequencies emanating from said teenager's car stereo tend to make objects on the adjacent car's dash rattle. Aside from loud speaker systems being applied to cars their application has also been made to outdoor, and in particular to premium outdoor, sound systems. Outdoor audio systems typically try to hide or conceal the speakers in order to preserve the natural effect in gardens where they are often disposed. Sub woofers pose a unique problem to outdoor instillation due to their construction. Due to their large size they are often difficult to conceal (either above ground as being visible, or below ground and interfering with other concealed or buried structures such as sprinklers wiring and the like). And thus, better methods of concealment are desirable to preserve a natural setting.

Also their size and construction has lead for them to be disposed in outdoor instillations typically where the sub-woofer drivers are disposed in the speaker turned facing up (audio axis vertical). This is different from indoor instillations where the speakers may typically be disposed facing in a horizontal direction (horizontal audio axis). Disposing the driver in this manner with a vertical audio axis can lead to problems with audio reproduction quality and premature degradation of the sub-woofer driver that may be desired to be eliminated.

Accordingly, there exists a need for an improved in-ground sub woofer for outdoor landscape installation which obviates the above and other deficiencies of conventional in-ground speakers such as cone popping and instillation interferences.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

The present example provides an in-ground omni-directional sub woofer speaker system having a cylindrical enclosure or housing which is fabricated of a material resistant to most environmental conditions. A driver is mounted in the housing or enclosure with the axis of the diaphragm or cone disposed coaxial with the axis of the cylindrical housing and substantially horizontal to grade level. The housing also contains the electronics for coupling to an audio signal source and a front firing band pass enclosure. A 90 degree tuned port assembly is adjustably attached to the housing end wall adjacent the driver cone in an eccentric position. The housing can be rotated at the time of installation to position the port assembly to maintain the proper spacing between a port canopy and the finished grade even in difficult site locations, thus providing optimum sound reproduction.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

Sub woofers are loud speakers for the reproduction of low frequencies generally in the range of 20 to 200 Hz and may be used in movie sound systems, car audio systems and for home audio systems including outdoor or landscaping systems. In outdoor uses the sub woofer may be buried in-ground to hide or conceal much of the enclosure.

Figure 1:
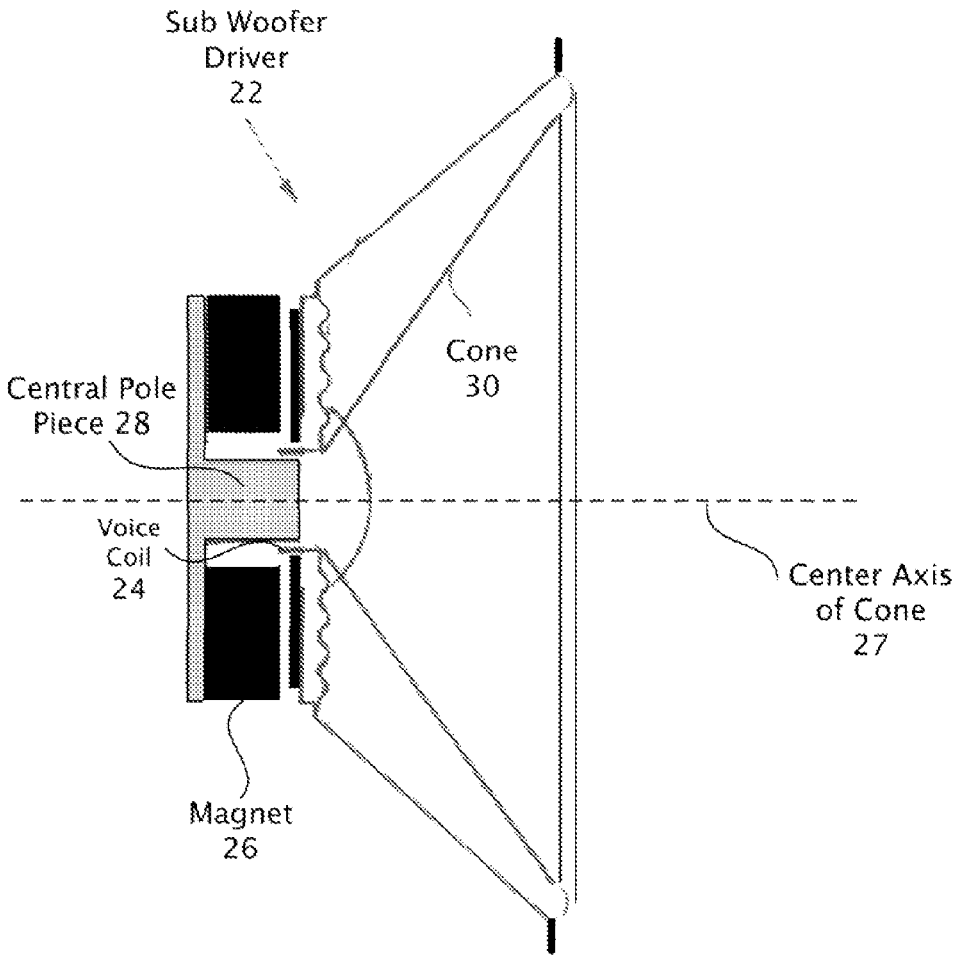
FIG. 1 is a diagram showing a sub woofer driver component as it would be disposed in the examples of an outdoor speaker enclosure described herein.

FIG. 1 is a cross section diagram showing a sub woofer driver component as it would be disposed in the examples of an outdoor speaker enclosure described herein. The driver 22 has a voice coil 24, a magnet 26 disposed around a central pole piece 28 and a diverging diaphragm or cone 30. For mechanical support a driver, or speaker, basket (not shown) would typically surround the cone 30. Typically the basket also provides points of attachment to couple the driver to a housing or other enclosure. The center axis of the cone 27 is shown horizontal as the driver would be mounted in the examples provided herein. However in conventional outdoor speaker assemblies the axis of the cone of such a driver would typically be oriented ninety degrees from that shown, or substantially vertical with respect to grade.

Sub woofers for in-ground installation are typically vertically mounted, that is, with the axis of the driver cone vertical and, as such, the driver is subject to the effects of gravity over time causing displacement of the voice coil resulting in the voice coil interference producing a loud, popping sound. Also, conventional vertically mounted in-ground speakers often encounter installation constraints which affect the depth of burial presenting possible interference with existing in-ground structures, such as sprinkler lines, electrical wires and the like.

Figure 2:
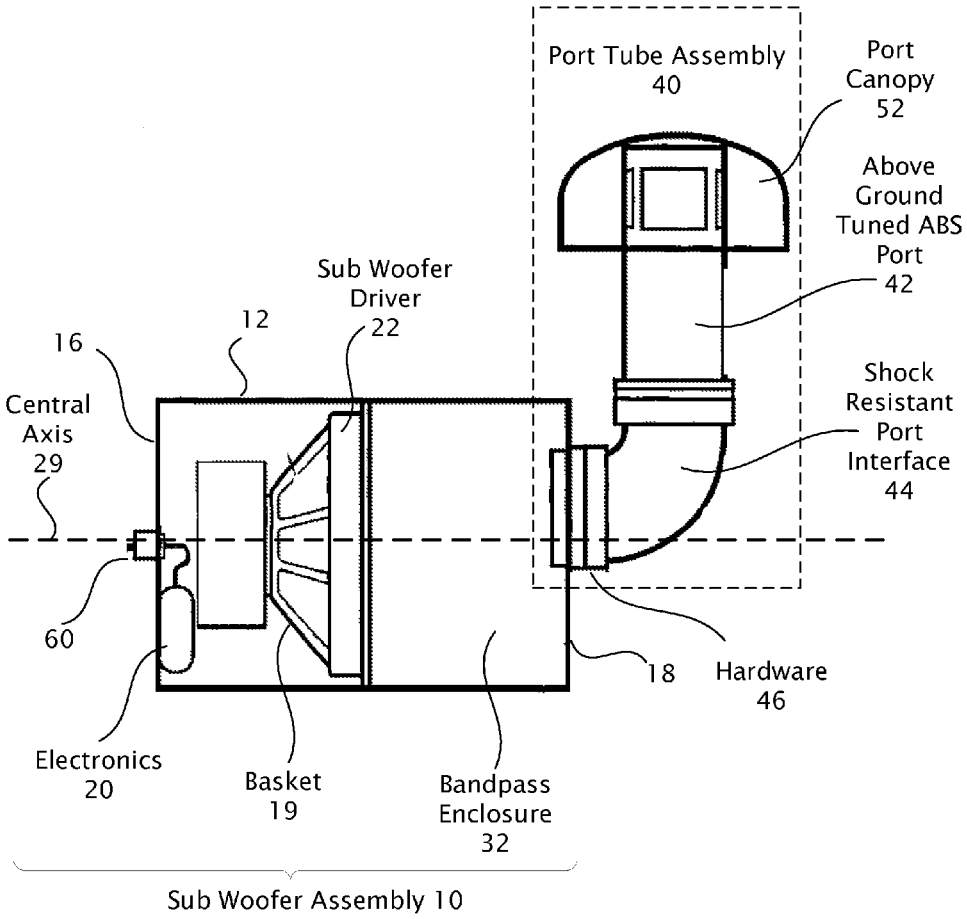
FIG. 2 is a cross-sectional view of the sub woofer of the present example.

FIG. 2 is a cross-sectional view of the sub woofer assembly of the present example. The sub woofer assembly 10 has a generally cylindrical enclosure or housing 12 having opposite end walls 16 and 18. However other shaped enclosures may equivalently be provided, typically to accommodate various shaped drivers 22, equivalently termed a woofer, woofer speaker or driver.

The housing 12 and end walls 16 and 18 may be fabricated from a suitable material for in-ground application such as PVC, polypropylene, fiberglass or the like. The end walls 16, 18 may be sealed to the housing 12 by suitable methods to prevent the intrusion of dirt, moisture, or other contaminants. Sealing may be by any suitable method including the addition of adhesives or other sealants if desired.

Prior in-ground sub woofers may have enclosures of aluminum and may decompose underground quickly, particularly in the presence of high salinity. As the enclosures corrode and lose strength, they can collapse under any sufficiently high applied weight, creating a safety problem.

The present examples utilize plastic material as opposed to metals such as aluminum, which are subject to erosion and consequently subject to collapsing.

The sub woofer driver 22 may be of various sizes. For most residential applications a 10" driver may be appropriate. As such the housing 12 will typically have an axial length of about 16" to enclose a 10" sub woofer driver. The driver basket 19 is typically round. However in equivalent alternative examples the basket 19 shape may equivalently be oval or other exemplary shapes. The shape of the driver basket, may be oval or some other shape differing from that of the housing 12, and its mounting may be facilitated by adding an adapter piece (not shown) to provide mounting between the differing shape of the housing and the driver. However in any such instillation the center axis of the driver cone (27 of FIG. 1) will remain substantially coaxial, or parallel to the housing axis 29.

Existing low frequency drivers in in-ground speakers are typically mounted vertically and the driver components are subject to displacement induced by gravity. Such sagging may misalign the voice coil (24 of FIG. 1) which will cause the voice coil to produce loud popping sounds. With the present invention, the internal low frequency driver is mounted horizontally eliminating the potential problem of sagging and the resultant undesirable audible effects.

The description and dimensions herein are based on a 10" driver 22 size. But it will be appreciated the present invention is applicable to other speaker sizes as the dimensions provided are exemplary.

Within the housing 12 may be located electronics 20, usually coupled to an audio source such as a remote amplifier or the like typically remotely disposed. The electronics may provide industry standard terminal impedances such as 4 ohm, 8 ohm or the like.

In a speaker system an enclosure typically provides a structure typically ported or otherwise constructed to allow moving air to circulate so that the sound may be effectively transmitted. In this example, a front firing band pass enclosure 32 is provided in the area of the housing between the driver 22 and the end wall 18. However, in alternative examples of enclosures other porting structures may be provided.

Sound is transmitted from the driver 22 via enclosure 32 through a port tube assembly 40 which has a tuned port 42 formed from a section of pipe such as 4" diameter PVC pipe for the exemplary 10" speaker. The port 42 has a fixed length and is connected to a resilient elbow 44 which serves as a shock resistant interface. Resilient elbow 44 is constructed from rubber, or other suitable materials to absorb shock and seal the assembly. The tuned port 42, the resilient elbow 44 and the port canopy 52 comprise the port tube assembly. The opposite end of the elbow 42 terminates at hardware 46 at end wall 18. The hardware is a coupling which allows relative rotation between the housing 12 and port tube assembly 40 at installation as will be more fully described below. The tube 40 is provided with apertures 50 at its upper end. A semi-spherical canopy 52 extends over the upper end of the port and protects against infiltration of moisture, dirt and debris. The canopy is preferably a copper or other material which will weather to an attractive, aesthetically pleasing patina. However any suitable material may be utilized. The distance above ground of the tuned port should equal the diameter of the tuned port, in this case 4", in order to obtain the desired increase of 3 decibels in sound level.

Figure 3:
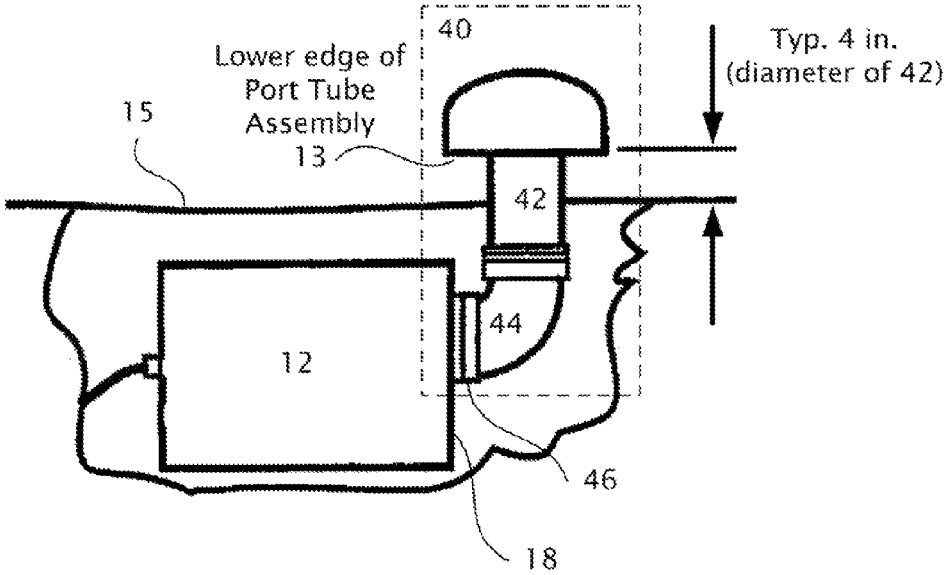
FIG. 3 is a side view showing the in-ground installation of the sub woofer according to the present invention.

FIG. 3 is a side view showing the in-ground installation of the sub woofer according to the present invention. The housing 12 is installed in a suitable outdoor location depending on the area, shape and landscaping of the area and the like. Installation is begun by excavating in an area that should not be subject to flooding. The excavation should be approximately 16" wide×26" long and have a depth of between 13"-

Figure 4:
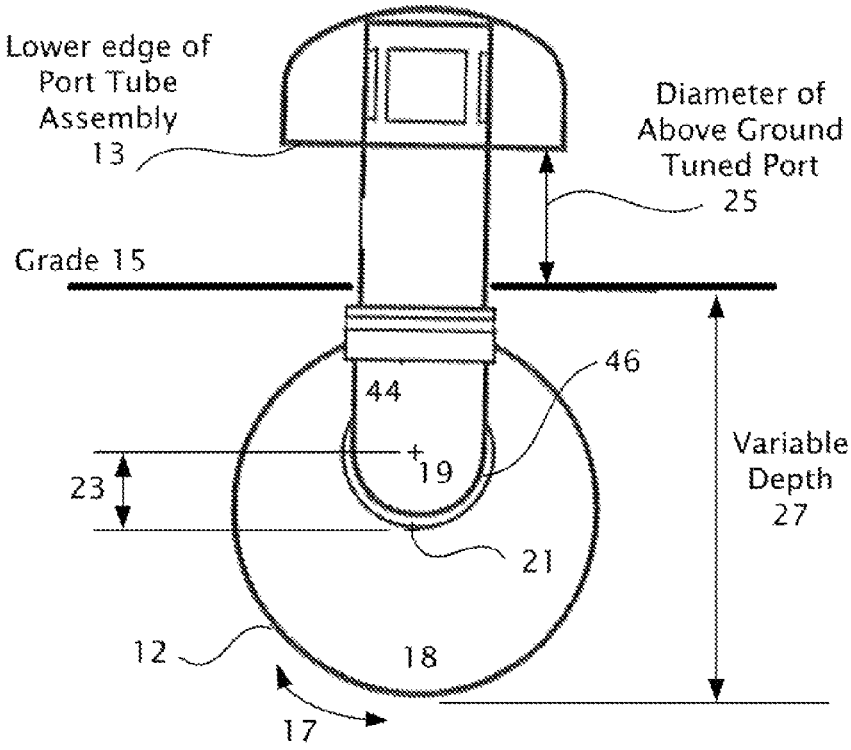
FIG. 4 is a front view of the installation of FIG. 3.

16" to accommodate a 10" sub woofer dimensioned as described above and should be prepared free of voids and rocks. The housing 12 is placed in the excavation in a horizontal position, as shown in FIGS. 3 and 4. The housing is positioned so that the elevation of the lower edge 13 of the port tube assembly 40 is 4" above finished grade 15. The port tube assembly 40 including the port tube 42 and resilient port interface 44 are then attached to the hardware 46 at housing end wall 18 in a selected position.

FIG. 4 is a front view of the installation of FIG. 3. As previously mentioned to maintain a 3 dB gain it is desirable to maintain a distance 25 equal to the diameter of the above ground tuned port between the grade 15 and the edge of the port canopy 13. In installations in which a hole can not be dug deep enough to provide the desired distance 25 adjustment is provided for in the design of the sub woofer assembly 12. The port interface is not coupled to the end cap at its center 21. The center of the tubular port interface 19 is offset 23 from the center 21 of the end cap 12. The tubular port interface 44 is rotabaly coupled 17 to the end wall 18 so that holes of variable depth 27 may be compensated for in instillation to maintain the desired distance 25 after instillation. Aside from clearing obstructions the adjustment mechanism also makes it easier to install the subwoofer speaker system and adjust the desired distance 25 without having to deepen the hole, or add material to the hole to raise the assembly.

Coupling of the port interface 44 to the end wall 18 is achieved with hardware 46 that is constructed utilizing techniques known to those skilled in the art to provide free rotation during assembly and suitably maintain a seal of the housing 12 to prevent the intrusion of moisture and other contaminants. Alternatively, the hardware 46 may be eliminated with the coupling mechanism integrally constructed into the port interface 44, the cap 18, or both 18, 44.

Figure 5:
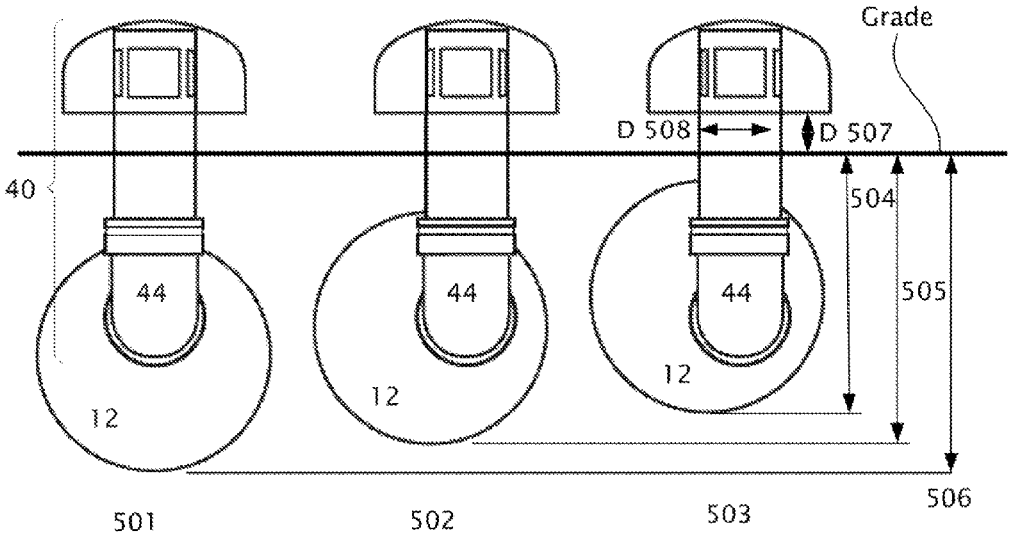
FIG. 5 is a front view illustrating several installation options available with the present invention.

FIG. 5 illustrates various positions 501, 502, 503 of the eccentric port tube 44 relative to the housing 12 to accommodate variable depth installation 504, 505, 506. As mentioned, the burial depth may be subject to limitation by existing in-ground obstacles or other considerations. If no obstacles exist, full depth installation for a 10" woofer requires the excavation to be 16" below grade. If the housing cannot be installed in a full depth excavation, the burial depth 504, 505, 506 can be varied, still maintaining the proper above ground spacing 507 (typically equal to the tuned port diameter 508) for the port tube assembly 40.

The installation is completed by connecting wires (60 of FIG. 2) using appropriate silicone filled wire connectors or their equivalent and appropriate junction boxes or their equivalent maintaining the proper polarity of the speaker wires. The resulting installation results in an in-ground sub woofer for omni-directional reproduction of outdoor sound. The sub woofer is intended for use in a system with other full range speakers to produce a full range of frequencies. The listening area for a 10" woofer installed as described above will be about 2000 sq. ft.

With current underground sub woofers, the tuned port has a fixed length determined by the accurate tuning of the sub woofer frequency. The tuned port is optimally 4" above the ground to obtain a 3 decibels gain since the diameter of the tube is 4". The burial depth of conventional sub woofer speakers is constrained by lack of adjustment, often resulting in conflict with underground conduits like sprinklers, electric wires, plumbing and the like. The present examples provide a cylindrical-shaped sub woofer enclosure or housing with a tuned port of proper fixed length attached to the end of the cylinder in an offset position. The port connects to the housing so that the orientation of the port remains vertical. As the housing is rotated, the offset port will extend above the outer periphery of the housing a distance approximately equal to the diameter of the housing 12. Hence, the diameter of the housing provides added flexibility in burial depth overcoming the aforementioned problems.

It will be obvious to those skilled in the art to make various changes, alterations and modifications to the invention described herein. To the extent such changes, alterations and modifications do not depart from the spirit and scope of the appended claims, they are intended to be encompassed therein.

Those skilled in the art will realize that the process sequences described above may be equivalently performed in any order to achieve a desired result. Also, sub-processes may typically be omitted as desired without taking away from the overall functionality of the processes described above.

The invention claimed is:

1. An in-ground audio sub woofer comprising:

a generally cylindrical housing having an axis having opposite first and second end walls;

a driver and electrical components for receiving and transmitting audio signals, said driver including a diaphragm coaxial with the axis of the cylindrical housing;

a port tube assembly having a tuned port tube with an upper end and a resilient interface elbow adjustably attached to the first end wall at an eccentric location relative to the housing axis; and a protective canopy extending over the upper end of the port tube assembly.

2. The in-ground sub woofer of claim 1 wherein the housing and port tube are selected from the group of material consisting of PVC, polypropylene and fiberglass.

3. The in-ground sub woofer of claim 1 wherein the protective canopy is metal.

4. A method of installing an in-ground audio sub woofer comprising:

providing a sub woofer including:

a generally cylindrical housing having an axis having opposite first and second end walls;

a driver and electrical components for receiving and transmitting audio signals, said driver including a diaphragm coaxial with the axis of the cylindrical housing;

a port tube assembly having a tuned port tube with an upper end and a resilient interface elbow adjustably attached to the first end wall at an eccentric location relative to the housing axis; and a protective canopy extending over the upper end of the port tube assembly;

providing an excavation below grade;

placing the sub woofer horizontally in the excavation and attaching the port tube assembly relative to the housing to project vertically a predetermined distance above grade; and connecting the sub woofer to an audio source.

5. The method of claim 4 wherein the predetermined distance above grade is established by the diameter of the tuned port tube.

6. An in ground speaker system comprising:

a driver speaker;

a housing having a central axis in which the driver is disposed with its center axis of a driver cone oriented in line or substantially parallel to the central axis of the housing; and a port tube assembly eccentrically coupled to an end cap of the housing such that a distance from a lower edge of the port canopy assembly to a grade level substantially equal to a diameter of an above around tuned port is maintained, in which, the housing is configured to be rotated relative to the port tube assembly to provide the distance from the lower edge of the port tuned assembly to the grade level substantially equal to the diameter of an above ground tuned port.

7. The in ground speaker system of claim 6 in which, the housing includes a forward band pass cavity.

8. The in ground speaker system of claim 6 in which, the port tube assembly includes a shock resilient port interface.

9. The in ground speaker system of claim 8 in which, the shock resilient port interface is a rubber elbow.

* * * * *